United States Patent [19]

Ritzmann et al.

[11] 3,989,482

[45] Nov. 2, 1976

[54] METHOD FOR THE REMOVAL OF DUST FROM EXHAUST GASES

[75] Inventors: Horst Ritzmann, Neubeckum, Germany; Johannes Paul Wohlfarth, Mexico City, Mexico

[73] Assignee: Polysius AG, Neubeckum, Germany

[22] Filed: Aug. 16, 1974

[21] Appl. No.: 497,904

Related U.S. Application Data

[63] Continuation of Ser. No. 241,133, April 5, 1972, abandoned.

[30] Foreign Application Priority Data

June 11, 1971 Germany ..... 2129111

[52] U.S. Cl. ..... 55/4; 55/11; 55/20; 55/80; 165/103; 165/119; 432/14; 432/58; 432/67

[51] Int. Cl.² ..... B03C 3/01

[58] Field of Search ..... 55/4, 5, 11, 20, 80, 55/135, 267; 165/103, 119; 432/14, 15, 58, 67

[56] References Cited

UNITED STATES PATENTS

| | | | |
|---|---|---|---|
| 1,586,115 | 5/1926 | Pistor et al. | 55/73 X |
| 1,914,604 | 6/1933 | Keenan, Jr. et al. | 165/103 X |
| 2,173,802 | 9/1939 | Downs et al. | 55/124 |
| 2,706,533 | 4/1955 | Hedberg et al. | 55/135 X |
| 2,729,301 | 1/1956 | Ekstrom, Jr. | 432/70 X |
| 2,746,563 | 5/1956 | Harlow | 55/4 X |
| 2,750,182 | 6/1956 | Petersen | 432/58 |
| 2,864,456 | 12/1958 | Hall et al. | 55/134 X |
| 2,882,033 | 4/1959 | Smith | 165/39 |
| 2,883,173 | 4/1959 | Laboulais | 432/16 |
| 3,162,431 | 12/1964 | Muller et al. | 55/134 X |
| 3,212,764 | 10/1965 | Muller et al. | 432/58 X |
| 3,237,375 | 3/1966 | Schwarz et al. | 55/106 X |
| 3,282,514 | 11/1966 | Putz | 55/11 X |
| 3,372,528 | 3/1968 | Hoff | 432/67 X |
| 3,444,668 | 5/1969 | Masuda | 266/15 X |
| 3,477,203 | 11/1969 | Luge et al. | 55/11 X |
| 3,512,340 | 5/1970 | Golucke et al. | 55/5 |
| 3,581,463 | 6/1971 | Roberts | 55/4 |
| 3,665,676 | 5/1972 | McKewen | 55/4 |
| 3,673,768 | 7/1972 | Leonard | 55/135 |
| 3,687,431 | 8/1972 | Parks | 432/15 |

FOREIGN PATENTS OR APPLICATIONS

| | | | |
|---|---|---|---|
| 1,017,146 | 10/1957 | Germany | 55/126 |
| 1,218,927 | 6/1966 | Germany | 432/58 |
| 1,003,377 | 9/1965 | United Kingdom | 55/267 |

OTHER PUBLICATIONS

Jahn, Ing. Gerhard, "Dust Collection in Cement Plants," *Filtration and Separation*, 9(4): pp. 417, 418, 420–422, July/Aug., 1972.

White, Harry J., "Industrial Electrostatic Precipitation," Addison–Wesley Publishing Co., Inc., Reading, Mass., c 1963, pp. 294, 300, 301, 303–305, 309, 328, 329.

*Primary Examiner*—Frank W. Lutter
*Assistant Examiner*—Kathleen J. Prunner
*Attorney, Agent, or Firm*—Marshall & Yeasting

[57] ABSTRACT

A stream of raw material is passed through a preheater to a furnace and a stream of exhaust gases from the furnace is passed through the preheater to preheat the raw material. Dust is electrostatically precipitated from the exhaust gases leaving the preheater, and the temperature of such exhaust gases is controllably raised to improve the efficiency of the dust removal by bypassing a controlled proportion of at least one of said streams around at least a portion of the preheater.

2 Claims, 2 Drawing Figures

METHOD FOR THE REMOVAL OF DUST FROM EXHAUST GASES

This is a continuation of application Ser. No. 241,133 filed Apr. 5, 1972 and now abandoned.

BACKGROUND OF THE INVENTION

This invention relates to a method for the electrostatic removal of dust from the exhaust gases of a plant in which raw material, for instance ground cement, is pre-heated with the exhaust gases from a furnace, and the exhaust gases from the pre-heater are subjected to electrostatic dust removal.

Increasingly more stringent demands are being made on the degree of dust removal in the exhaust gases from large production plants, for instance cement factories. The exhaust gases from the pre-heater which need the dust removal frequently are at a temperature between about 310° and 350° C, which is not well suited for electrostatic dust removal.

In order to improve the degree of dust removal, attempts have been made in such cases to lower appreciably the temperature of the exhaust gases by water-cooling (for instance down to a temperature range of about 150° to 170° C). This method cannot however be considered in those cases in which cooling water in sufficient quantities is not available.

It is known that dust removal in an electrostatic filter is considerably improved not only by a drop in the prevailing exhaust gas temperature, but also by an increase in this temperature (to a range for instance of 400° to 420° C). For this reason the efficiency of the pre-heater has hitherto been deliberately reduced by changing its shape, so as to increase the exhaust gas temperature. The main disadvantage of such a method is that the plant is always operating at high heat consumption.

SUMMARY OF THE INVENTION

The object of the invention is therefore to provide a method which permits effective dust removal without cooling the exhaust gases from the pre-heater, and in addition allows the plant to be operated at least part of the time with the minimum possible heat consumption.

According to the invention this object is achieved in that the temperature of the pre-heater exhaust gases is brought to a value suitable for electrostatic dust removal by causing part of the raw material and/or part of the furnace exhaust gases to by-pass at least one stage of the pre-heater.

This rise in the temperature of the pre-heater exhaust gases can be achieved in a simple and technically easily controllable manner by by-passing part of the raw material and/or a part of the furnace exhaust gases to one or more stages of the pre-heater. As compared with the improvement achieved in removal of dust from the exhaust gases, the consequent slight reduction in thermal efficiency is of no practical significance. In addition it is always possible to cancel the by-pass feed and operate with the minimum possible heat consumption in cases in which dust-removal presents no problem.

If the exhaust gases from the pre-heater are used for grind-drying and only subsequently freed from dust, then in accordance with a preferred embodiment of the present method the by-pass feed is switched out, so that all the raw material and the total amount of furnace exhaust gases are taken through the pre-heater. In this case in fact the grind-drying causes such extensive cooling of the pre-heater exhaust gases that this alone ensures a favorable temperature range for the electrostatic dust removal.

The proportion of the raw material and/or the furnace exhaust gases taken through by-pass is preferably adjustable between 0 and about 25% of the total quantity. The control of the proportion of raw material or furnace exhaust gases taken through the by-pass is preferably effected in dependence on the degree of dust removal in the electrostatic filter, by measuring the dust content of the exhaust gases after the dust removal, and controlling in accordance with such dust content the proportion of at least one of the streams which is bypassed around at least a portion of the pre-heater, to maintain a desired minimum dust content. This in particular enables the feed of the raw material to be controlled by simple means and without high thermal stressing of the adjustment members.

DESCRIPTION OF THE PREFERRED EMBODIMENT

Figure 1:
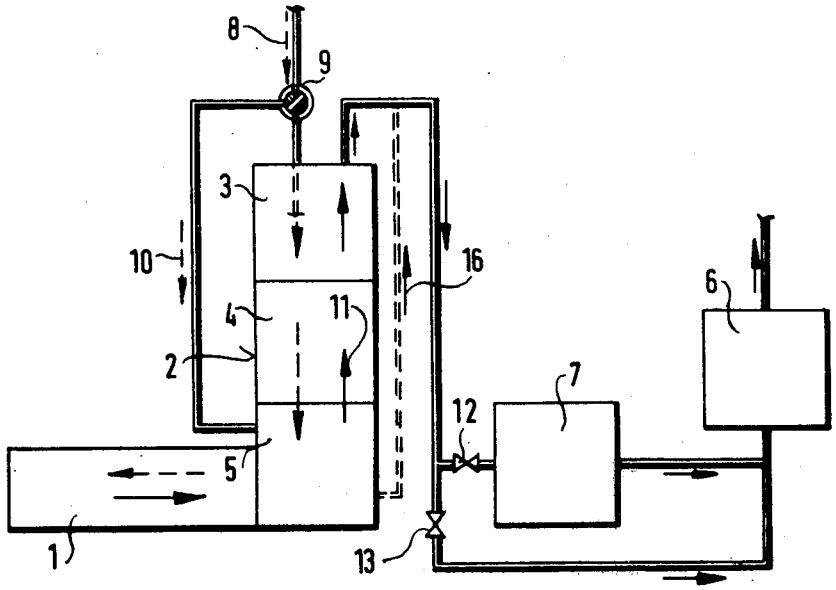
FIG. 1 is the lay-out of a plant for carrying out the method in accordance with the invention.

The plant represented in FIG. 1, used for instance in the production of cement, comprises a rotary tube furnace 1 and a pre-heater 2 — indicated schematically — (for instance a gas suspension pre-heater of any desired construction), consisting of the stages 3, 4, 5.

The plant also includes an electrostatic filter 6 and a mill 7 which can be switched on to dry the raw material.

The raw material (arrow 8) is fed by a distributor 9 firstly to the top stage 3 of the pre-heater 2, and to a smaller extent (arrow 10) directly into the lowest stage 5 of the pre-heater, by-passing the stages 3 and 4.

The exhaust gases from the rotary tube furnace 1 (arrow 11) pass through the pre-heater 2 from below, and with the valve 12 closed are fed through the valve 13 to the dust remover 6.

Figure 2:
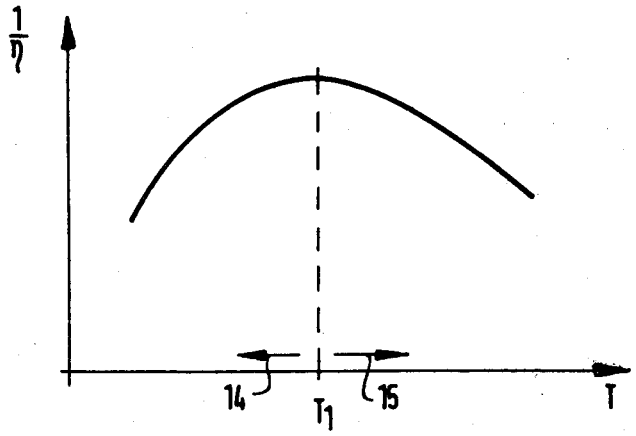
FIG. 2 is a diagram to explain the dust removal conditions in relation to the exhaust gas temperatures.

In order to explain the effect of by-passing part of the raw material in accordance with the invention, the diagram in FIG. 2 should be considered. This shows the electrical resistance of the dust contained in the final exhaust gas leaving the dust remover 6 (which is inversely proportional to the degree of dust removal $n$) in relation to the temperature T of the exhaust gases from the pre-heater 2. It will be seen that the least favorable dust removal conditions are present in an area around the temperature $T_1$. The exhaust gases of the pre-heater 2 have in general a temperature of this order of magnitude when the entire quantity of raw material and all the exhaust gases from the rotary tube furnace are passed in the normal manner through the pre-heater 2.

While attempts were previously made to drop the gas temperature in the dust-remover in relation to the value $T_1$ by cooling the exhaust gases from the pre-heater 2 (arrow 14), the invention takes precisely the opposite route. Since part of the raw material (arrow 10) is fed in by-pass fashion past two stages of the pre-heater, there is an increase in the temperature of the exhaust gases from the pre-heater 2 (arrow 15). In this manner an area with a more favorable degree of dust-removal in the electrostatic filter 6 is also reached.

The same effect can also be achieved by taking part of the exhaust gases from the rotary tube furnace 1 in by-pass fashion past one or more stages of the pre-heater (arrow 16). This again enables the temperature of the total amount of exhaust gases to be brought to a value suitable for electrostatic dust removal.

Finally it will be understood that both features (by-passing of part of the raw material and of part of the furnace exhaust gases) can be combined.

Should the exhaust gases from the pre-heater 2 be used for grind-drying in the mill 7 (with valve 12 open and valve 13 closed), the by-passing of the raw material and/or of the furnace exhaust gases is preferably stopped, since in this case the grind-drying produces such extensive cooling of the pre-heater exhaust gases that no difficulties occur in the electrostatic filter 6.

We claim:

1. A method of minimizing pollution of the atmosphere by dust contained in furnace exhaust gases used to preheat particulate solid raw material entering a furnace, comprising the steps of passing a stream of particulate solid raw material downward through a heat-exchange path into the furnace, passing a stream of the furnace exhaust gases upward through said heat-exchange path in contact with said stream of material to preheat said material while cooling the exhaust gases, and then passing the cooled exhaust gases through an electrostatic precipitator, the temperature of the exhaust gases entering the precipitator being in the range from 310° t 350° C, wherein the improvement comprises the steps of a. measuring the dust content of the exhaust gases leaving the precipitator, b. bypassing around at least a part of said heat exchange path a portion of one of said streams to prevent contact between said stream of particulate solid raw material and said stream of exhaust gases whereby the temperature of the exhaust gases entering the precipitator is raised as compared to the temperature of the gases entering the precipitator in said range, and c. controlling the amount of the bypassed portion in accordance with said dust content to raise the temperature of the exhaust gases entering the precipitator above said range, thereby appreciably reducing said dust content.

2. A method according to claim 1 wherein the bypassed portion is not more than 25%.

* * * * *